US011168688B2

(12) United States Patent
Koike et al.

(10) Patent No.: US 11,168,688 B2
(45) Date of Patent: Nov. 9, 2021

(54) SCROLL COMPRESSOR

(71) Applicant: KABUSHIKI KAISHA TOYOTA JIDOSHOKKI, Kariya (JP)

(72) Inventors: Shinji Koike, Kariya (JP); Takuro Yamashita, Kariya (JP); Yuya Hattori, Kariya (JP); Takumi Maeda, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 58 days.

(21) Appl. No.: 16/828,009

(22) Filed: Mar. 24, 2020

(65) Prior Publication Data

US 2020/0309127 A1 Oct. 1, 2020

(30) Foreign Application Priority Data

Mar. 27, 2019 (JP) ..... JP2019-060976

(51) Int. Cl.

| | |
|---|---|
| ***F04C 18/02*** | (2006.01) |
| ***F04C 29/00*** | (2006.01) |
| ***F04C 27/00*** | (2006.01) |
| ***F04C 23/00*** | (2006.01) |

(52) U.S. Cl.

CPC ..... *F04C 18/0215* (2013.01); *F04C 23/008* (2013.01); *F04C 29/0021* (2013.01); *F04C 18/0253* (2013.01); *F04C 27/005* (2013.01); *F04C 29/0057* (2013.01); *F04C 2240/56* (2013.01); *F04C 2240/807* (2013.01)

(58) Field of Classification Search

CPC .... F04C 18/0215; F04C 27/005; F04C 29/00; F04C 29/0021; F04C 29/0057; F04C 18/0253; F04C 2240/801

See application file for complete search history.

(56) References Cited

U.S. PATENT DOCUMENTS

| | | | | |
|---|---|---|---|---|
| 2004/0136855 | A1* | 7/2004 | Kimura | F04C 27/005 418/55.5 |
| 2004/0191082 | A1* | 9/2004 | Gennami | F04C 29/028 417/310 |
| 2009/0191081 | A1* | 7/2009 | Lee | F04C 29/026 418/55.6 |

(Continued)

FOREIGN PATENT DOCUMENTS

| | | | |
|---|---|---|---|
| JP | 2011080376 A | * | 4/2011 |
| JP | 2015-034506 A | | 2/2015 |

*Primary Examiner* — Mark A Laurenzi
*Assistant Examiner* — Xiaoting Hu
(74) *Attorney, Agent, or Firm* — Sughrue Mion, PLLC

(57) ABSTRACT

A scroll compressor includes a housing, a rotary shaft, a movable scroll, an eccentric shaft, an opposed wall, a looped elastic plate, a looped support portion, an annular protrusion, a back pressure chamber, and a back pressure supplying groove. The distance in the radial direction of the rotary shaft from the rotation axis of the rotary shaft to then outer end of the back pressure supplying groove in the radial direction of the rotary shaft is shorter than or equal to the distance obtained by subtracting the distance in the radial direction of the rotary shaft between the rotation axis of the rotary shaft and the axis of the eccentric shaft from the distance in the radial direction of the rotary shaft from the axis of the eccentric shaft to the part of the protrusion that contacts the elastic plate.

5 Claims, 4 Drawing Sheets

(56) References Cited

U.S. PATENT DOCUMENTS

2011/0243777 A1* 10/2011 Ito ..... F04C 27/005
418/55.2
2013/0259726 A1* 10/2013 Yamashita ..... F04C 18/0253
418/55.1

* cited by examiner

SCROLL COMPRESSOR

BACKGROUND

1. Field

The present disclosure relates to a scroll compressor.

2. Description of Related Art

Japanese Laid-Open Patent Publication No. 2015-34506 discloses a scroll compressor 100 that includes a housing 101 and a rotary shaft 102 accommodated therein as shown in FIG. 5. The rotary shaft 102 is rotationally supported by the housing 101. The scroll compressor 100 includes a stationary scroll 103, which is fixed to the housing 101, and a movable scroll 104, which is capable of orbiting with respect to the stationary scroll 103.

The stationary scroll 103 includes a stationary base plate 103*a* and a stationary volute wall 103*b*, which extends from the stationary base plate 103*a*. The movable scroll 104 includes a movable base plate 104*a*, which is opposed to the stationary base plate 103*a*, and a movable volute wall 104*b*, which extends from the movable base plate 104*a* toward the stationary base plate 103*a* and meshes with the stationary volute wall 103*b*. A compression chamber 105 is defined between the structure including the stationary base plate 103*a* and the stationary volute wall 103*b* and the structure including the movable base plate 104*a* and the movable volute wall 104*b*. The rotary shaft 102 has an eccentric shaft 106, which protrudes toward the movable scroll 104 from a position eccentric from the rotation axis L100. The eccentric shaft 106 supports the movable scroll 104.

In the scroll compressor 100, when the rotary shaft 102 rotates, the eccentric shaft 106 revolves about the rotation axis L100 of the rotary shaft 102. This causes the movable scroll 104 to orbit about the rotation axis L100 of the rotary shaft 102 while being prevented from rotating. The orbiting motion of the movable scroll 104 with respect to the stationary scroll 103 reduces the volume of the compression chamber 105, so that fluid that has been drawn into the compression chamber 105 is compressed.

The scroll compressor 100 also includes a looped elastic plate 107, which urges the movable scroll 104 toward the stationary scroll 103. The scroll compressor 100 includes an opposed wall 108, which is located on the opposite side of the movable base plate 104*a* to the stationary base plate 103*a*. The rotary shaft 102 extends through the opposed wall 108. The elastic plate 107 is disposed between the movable base plate 104*a* and the opposed wall 108.

As shown in FIGS. 5 and 6, the opposed wall 108 has an opposed surface 108*a*, which is opposed to the elastic plate 107 and has a looped support portion 109. The support portion 109 supports the elastic plate 107. The opposed surface 108*a* includes a looped groove 110, which is located on the outer side of the support portion 109 in the radial direction of the rotary shaft 102. Further, the movable base plate 104*a* has an annular protrusion 111 in a position that overlaps with the looped groove 110 in the axial direction of the rotary shaft 102. The protrusion 111 contacts the elastic plate 107.

As shown in FIG. 5, the housing 101 has a back pressure chamber 112 defined therein. The back pressure chamber 112 introduces fluid that urges the movable scroll 104 toward the stationary scroll 103. The back pressure chamber 112 includes a first back pressure space 112*a* and a second back pressure space 112*b*. The first back pressure space 112*a* is located on the inner side of the support portion 109 in the radial direction of the rotary shaft 102. The second back pressure space 112*b* is located between the movable base plate 104*a* and the elastic plate 107 and on the inner side of the protrusion 111 in the radial direction of the rotary shaft 102. The second back pressure space 112*b* is continuous with the first back pressure space 112*a*. The pressure of the fluid supplied into the first back pressure space 112*a* and the pressure of the fluid supplied into the second back pressure space 112*b* urge the movable scroll 104 toward the stationary scroll 103. This causes the distal end of the movable volute wall 104*b* to contact the stationary base plate 103*a* and causes the distal end of the stationary volute wall 103*b* to contact the movable base plate 104*a*. This ensures the sealing of the compression chamber 105.

When the movable scroll 104 orbits with respect to the stationary scroll 103 with the protrusion 111 contacting the elastic plate 107, the looped groove 110 allows the elastic plate 107 to be elastically deformed in a manner bulging away from the movable base plate 104*a*. The restoring force that acts to restore the original shape of the elastic plate 107 acts on the protrusion 111 of the movable scroll 104, so that the movable scroll 104 is urged toward the stationary scroll 103. This configuration urges the movable scroll 104 toward the stationary scroll 103 even when the pressure of the fluid introduced to the back pressure chamber 112 has not been increased, for example, when the scroll compressor 100 is started. This improves the sealing of the compression chamber 105.

As shown in FIGS. 5 and 6, back pressure supplying grooves 114 are provided in the opposed surface 108*a* in some parts in the circumferential direction. The back pressure supplying grooves 114 extend beyond the support portion 109 to connect the first back pressure space 112*a* and the looped groove 110 to each other, thereby supplying fluid in the first back pressure space 112*a* to the looped groove 110. Accordingly, the fluid in the first back pressure space 112*a* is supplied to the entire looped groove 110 via the back pressure supplying grooves 114. Thus, the pressure of the fluid in the back pressure supplying grooves 114 and the pressure of the fluid in the looped groove 110 limit elastic deformation of the elastic plate 107 into the looped groove 110 due to the pressure in the second back pressure space 112*b*. Then, the fluid in the back pressure supplying grooves 114 and the pressure that has been supplied to the entire looped groove 110 urge the movable scroll 104 toward the stationary scroll 103 via the elastic plate 107 and the pressure in the second back pressure space 112*b*. This allows the movable scroll 104 to stably urge the stationary scroll 103, thereby improving the sealing of the compression chamber 105.

When the fluid in the first back pressure space 112*a* is supplied to the looped groove 110 via the back pressure supplying grooves 114, the fluid from the first back pressure space 112*a* concentrates in the back pressure supplying grooves 114. Accordingly, the pressure in the back pressure supplying grooves 114 is locally high in relation to the pressure in the looped groove 110. Therefore, depending on the positional relationship between the back pressure supplying grooves 114 and the movable scroll 104 during orbiting motion of the movable scroll 104, the pressure of the fluid in the back pressure supplying grooves 114 may locally deform the elastic plate 107. Particularly, when the scroll compressor 100, which compresses refrigerant, or fluid, is started, liquefied refrigerant may flow into the back pressure supplying grooves 114. In such a case, the elastic plate 107 is highly likely to be locally deformed. If the elastic plate 107 is locally deformed, the movable scroll 104 is not evenly urged toward the stationary scroll 103. This hampers the sealing of the compression chamber 105 or creates a great friction force between the movable scroll 104 and the stationary scroll 103, leading to a reduced efficiency.

SUMMARY

It is an objective of the present disclosure to provide a scroll compressor that limits local deformation of an elastic plate that urges a movable scroll toward a stationary scroll.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a scroll compressor is provided that includes a housing, a rotary shaft, a stationary scroll, a movable scroll, an eccentric shaft, an opposed wall, an elastic plate a looped support portion, a looped groove, an annular protrusion, a back pressure chamber, and a back pressure supplying groove. The rotary shaft is rotationally supported by the housing. The stationary scroll includes a stationary base plate and a stationary volute wall extending from the stationary base plate. The stationary scroll is fixed to the housing. The movable scroll includes a movable base plate that is opposed to the stationary base plate and a movable volute wall that extends from the movable base plate toward the stationary base plate and meshes with the stationary volute wall. The movable scroll is capable of orbiting with respect to the stationary scroll. The eccentric shaft protrudes toward the movable scroll from a position in the rotary shaft eccentric from a rotation axis. The eccentric shaft supports the movable scroll. The opposed wall is located on an opposite side of the movable base plate to the stationary base plate. The elastic plate is disposed between the movable base plate and the opposed wall and urges the movable scroll toward the stationary scroll. The looped support portion is provided on an opposed surface of the opposed wall that is opposed to the elastic plate. The support portion supports the elastic plate. The looped groove is provided in the opposed surface on an outer side of the support portion in a radial direction of the rotary shaft. The annular protrusion protrudes from a part of the movable base plate that overlaps with the looped groove in an axial direction of the rotary shaft. The protrusion contacts the elastic plate. The back pressure chamber includes a first back pressure space and a second back pressure space. The first back pressure space is located on an inner side of the support portion in the radial direction of the rotary shaft in the housing. The second back pressure space is located between the movable base plate and the elastic plate and on an inner side of the protrusion in the radial direction of the rotary shaft. The second back pressure space is continuous with the first back pressure space. Fluid that urges the movable scroll toward the stationary scroll is introduced to the back pressure chamber. The back pressure supplying groove is provided in a part of the opposed surface in a circumferential direction of the rotary shaft, extends beyond the support portion to connect the first back pressure space and the looped groove to each other, and supplies fluid in the first back pressure space to the looped groove. A distance in the radial direction of the rotary shaft from the rotation axis of the rotary shaft to an outer end of the back pressure supplying groove in the radial direction of the rotary shaft is shorter than or equal to a distance obtained by subtracting a distance in the radial direction of the rotary shaft between the rotation axis of the rotary shaft and an axis of the eccentric shaft from a distance in the radial direction of the rotary shaft from the axis of the eccentric shaft to a part of the protrusion that contacts the elastic plate.

Other aspects and advantages of the present disclosure will become apparent from the following description, taken in conjunction with the accompanying drawings, illustrating exemplary embodiments.

BRIEF DESCRIPTION OF THE DRAWINGS

The disclosure may be understood by reference to the following description together with the accompanying drawings.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A scroll compressor 10 according to an embodiment will now be described with reference to FIGS. 1 to 3. The scroll compressor 10 of the present embodiment is mounted on a vehicle and employed for a vehicle air conditioner.

Figure 1:
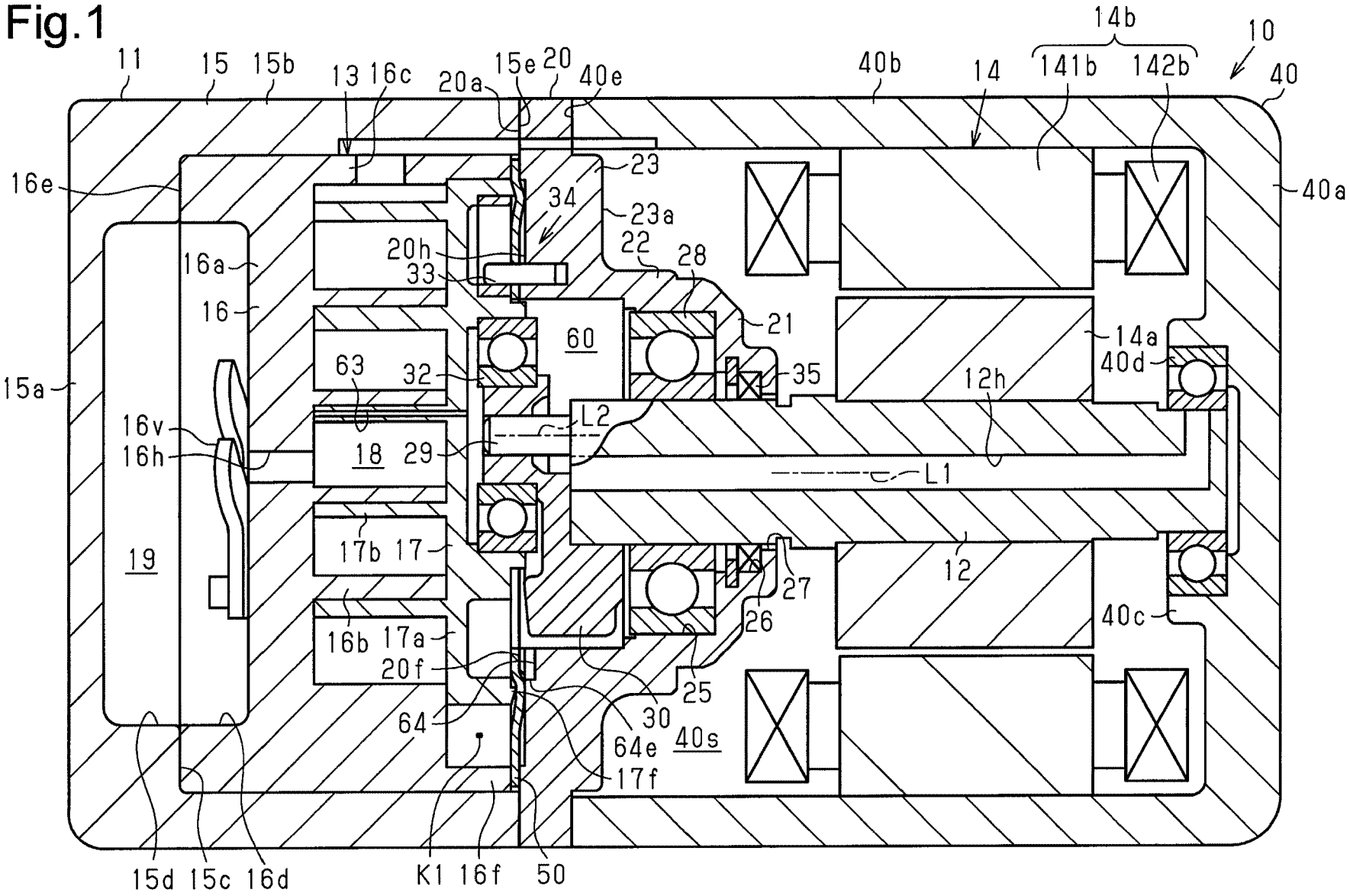
FIG. 1 is a cross-sectional side view illustrating a scroll compressor according to an embodiment.

As shown in FIG. 1, the scroll compressor 10 includes a tubular housing 11, a rotary shaft 12 accommodated in the housing 11, a compression portion 13, which compresses refrigerant, or fluid, as the rotary shaft 12 rotates, and an electric motor 14, which drives a compression portion 13.

The housing 11 includes a discharge housing member 15, a shaft support housing member 20, which is coupled to the discharge housing member 15, and a motor housing member 40, which is coupled to the shaft support housing member 20. The discharge housing member 15, the shaft support housing member 20, and the motor housing member 40 each have a tubular shape with a closed end. The discharge housing member 15, the shaft support housing member 20, and the motor housing member 40 are made of metal such as aluminum.

The discharge housing member 15 includes a plate-shaped bottom wall 15*a* and a tubular circumferential wall 15*b*, which extends from the outer circumference of the bottom wall 15*a*. The direction in which the axis of the circumferential wall 15*b* extends matches the direction in which the rotation axis L1 of the rotary shaft 12 extends (axial direction). The compression portion 13 is accommodated in the discharge housing member 15.

The motor housing member 40 includes a plate-shaped bottom wall 40*a* and a tubular circumferential wall 40*b*, which extends from the outer circumference of the bottom wall 40*a*. The circumferential wall 40*b* of the motor housing member 40 includes an opening edge 40*e* at the side opposite to the bottom wall 40*a*. The circumferential wall 15*b* of the discharge housing member 15 includes an opening edge 15*e* at the side opposite to the bottom wall 15*a*. The opening edge 15*e* and the opening edge 40*e* face each other in the axial direction of the rotary shaft 12. The direction in which the axis of the circumferential wall 15*b* of the discharge housing member 15 matches the direction in which the axis of the circumferential wall 40*b* of the motor housing member 40 extends.

The motor housing member 40 has a suction port (not shown). Also, the discharge housing member 15 has a discharge port (not shown). The suction port is connected to one end of an external refrigerant circuit (not shown), and the discharge port is connected to the other end of the external refrigerant circuit.

The electric motor 14 is accommodated in the motor housing member 40. The electric motor 14 and the compression portion 13 are arranged along the axial direction of the rotary shaft 12. The electric motor 14 has a rotor 14*a*, which rotates integrally with the rotary shaft 12, and a tubular stator 14*b*, which surrounds the rotor 14*a*. The stator 14*b* includes a tubular stator core 141*b* and a coil 142*b*. The stator core 141*b* is fixed to the inner circumferential surface of the circumferential wall 40*b* of the motor housing member 40. The coil 142*b* is wound about the stator core 141*b*. When power that is controlled by a drive circuit (not shown) is supplied to the coil 142*b*, the electric motor 14 is activated, so that the rotary shaft 12 and the rotor 14*a* rotate integrally.

A cylindrical boss 40*c* protrudes from the inner surface of the bottom wall 40*a* of the motor housing member 40. The end of the rotary shaft 12 on the side opposite to the compression portion 13 is inserted into the boss 40*c*. A rolling-element bearing 40*d* is disposed between the inner circumferential surface of the boss 40*c* and the outer circumferential surface of the end of the rotary shaft 12 on the side opposite to the compression portion 13. The end of the rotary shaft 12 on the side opposite to the compression portion 13 is rotationally supported by the motor housing member 40 via the rolling-element bearing 40*d*.

The compression portion 13 includes a stationary scroll 16 and a movable scroll 17, which is arranged to face the stationary scroll 16. The stationary scroll 16 is located between the movable scroll 17 and the bottom wall 15*a* of the discharge housing member 15 in the axial direction of the rotary shaft 12.

The stationary scroll 16 includes a disk-shaped stationary base plate 16*a* and a stationary volute wall 16*b*, which extends in a direction away from the bottom wall 15*a*. The stationary scroll 16 includes a tubular stationary outer circumferential wall 16*c*, which extends from the outer circumference of the stationary base plate 16*a*. The stationary outer circumferential wall 16*c* surrounds the stationary volute wall 16*b*. The stationary scroll 16 further includes a cylindrical extended portion 16*f*, which extends from the outer circumference of the end face of the stationary outer circumferential wall 16*c*. The stationary scroll 16 is fixed to the discharge housing member 15.

The movable scroll 17 includes a disk-shaped movable base plate 17*a*, which is opposed to the stationary base plate 16*a*, and a movable volute wall 17*b*, which extends from the movable base plate 17*a* toward the stationary base plate 16*a*. The movable base plate 17*a* is arranged on the inner side of the extended portion 16*f* of the stationary scroll 16. The outer diameter of the movable base plate 17*a* is smaller than the inner diameter of the extended portion 16*f* The movable volute wall 17*b* is arranged on the inner side of the stationary outer circumferential wall 16*c* of the stationary scroll 16. The stationary volute wall 16*b* and the movable volute wall 17*b* mesh with each other on the inner side of the stationary outer circumferential wall 16*c*. The distal end face of the stationary volute wall 16*b* contacts the movable base plate 17*a*, and the distal end face of the movable volute wall 17*b* contacts the stationary base plate 16*a*. A compression chamber 18 is defined between the structure including the stationary base plate 16*a* and the stationary volute wall 16*b* and the structure including the movable base plate 17*a* and the movable volute wall 17*b*. The compression chamber 18 compresses refrigerant.

The stationary base plate 16*a* has an end face 16*e* located on the side opposite to the movable scroll 17. The end face 16*e* contacts an inner bottom surface 15*c* of the bottom wall 15*a* of the discharge housing member 15. The discharge housing member 15 has a first discharge chamber defining recess 15*d*, which is provided in the inner bottom surface 15*c* of the bottom wall 15*a*. The stationary base plate 16*a* has a second discharge chamber defining recess 16*d*, which is provided in the end face 16*e*. The first discharge chamber defining recess 15*d* and the second discharge chamber defining recess 16*d* define the discharge chamber 19.

A discharge port 16*h* is provided at the center of the bottom surface of the second discharge chamber defining recess 16*d*. A valve mechanism 16*v*, which selectively opens and closes the discharge port 16*h*, is attached to the bottom surface of the second discharge chamber defining recess 16*d*. The refrigerant that has been compressed in the compression chamber 18 by the compression portion 13 is discharged to the discharge chamber 19 via the discharge port 16*h*.

Figure 2:
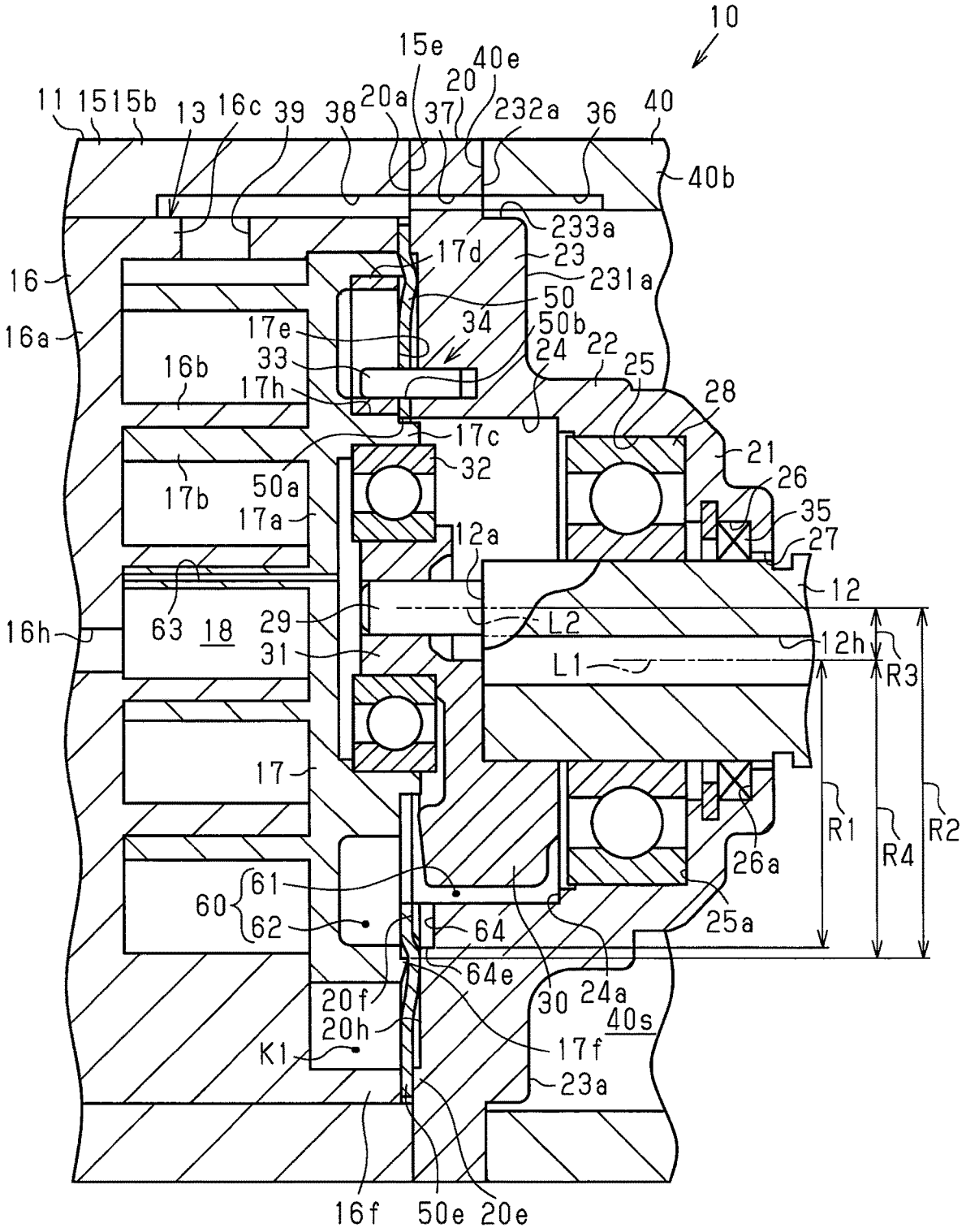
FIG. 2 is an enlarged cross-sectional view showing a part of the scroll compressor of FIG. 1.

As shown in FIG. 2, the movable base plate 17*a* has an end face 17*e* located on the side opposite to the stationary scroll 16. A cylindrical boss 17*c* protrudes from the end face 17*e*. The direction in which the axis of the boss 17*c* extends matches the axial direction of the rotary shaft 12. The movable base plate 17*a* has multiple anti-rotation recesses 17*h*, which are defined in the end face 17*e* and located about the boss 17*c*. The anti-rotation recesses 17*h* are circular holes. The anti-rotation recesses 17*h* are arranged at predetermined intervals in the circumferential direction of the rotary shaft 12. An annular ring member 17*d* is fitted in each of the anti-rotation recesses 17*h*. The movable base plate 17*a* has an annular protrusion 17*f* The protrusion 17*f* protrudes from a part of the end face 17*e* of the movable base plate 17*a* that is on the outer side of the anti-rotation recesses 17*h* in the radial direction of the rotary shaft 12. The protrusion 17*f* protrudes cylindrically from the outer circumference of the end face 17*e* of the movable base plate 17*a*. The protrusion 17*f* surrounds the boss 17*c*.

The shaft support housing member 20 includes a plate-shaped bottom wall 21 and a tubular circumferential wall 22, which extends from the outer circumference of the bottom wall 21. The direction in which the axis of the circumferential wall 22 extends matches the axial direction of the rotary shaft 12. The shaft support housing member 20 includes an annular flange wall 23, which extends from an end of the outer circumferential surface of the circumferential wall 22 that is on the side opposite to the bottom wall 21. The flange wall 23 extends outward in the radial direction of the rotary shaft 12.

The flange wall 23 has an end face 23*a* located close to the bottom wall 21. The end face 23*a* includes a looped first surface 231*a* and second surface 232*a*, which extend in the radial direction of the rotary shaft 12. The first surface 231*a* is continuous with the outer circumferential surface of the circumferential wall 22 and extends in the radial direction of the rotary shaft 12 from an end of the outer circumferential surface of the circumferential wall 22 that is on the opposite side to the bottom wall 21. The second surface 232*a* is located on the outer side of the first surface 231*a* in the radial direction of the rotary shaft 12 and is located at a position that is more separated from the bottom wall 21 than the first surface 231*a* in the axial direction of the rotary shaft 12. The outer circumferential edge of the first surface 231*a* on the outer side in the radial direction of the rotary shaft 12 and the inner circumferential edge of the second surface 232*a* on the inner side in the radial direction of the rotary shaft 12 are connected to each other by a looped step surface 233*a*, which extends in the axial direction of the rotary shaft 12.

The opening edge 15*e* of the circumferential wall 15*b* of the discharge housing member 15 contacts the outer circumferential portion of an end face 20*a* of the shaft support housing member 20 that is located on the side opposite to the bottom wall 21. The opening edge 40*e* of the circumferential wall 40*b* of the motor housing member 40 contacts the second surface 232*a* of the flange wall 23 of the shaft support housing member 20. The shaft support housing member 20, the bottom wall 40*a* of the motor housing member 40, and the circumferential wall 40*b* define a motor chamber 40*s*, which accommodates the motor 14. Refrigerant is drawn into the motor chamber 40*s* from the external refrigerant circuit via the suction port. The motor chamber 40*s* is thus a suction chamber, into which refrigerant is drawn through the suction port, and is a suction pressure zone.

The circumferential wall 22 as a large diameter recess 24 and a bearing accommodating recess 25. The bottom wall 21 has a sealing member accommodating recess 26 and an insertion hole 27. The axis of the large diameter recess 24, the axis of the bearing accommodating recess 25, the axis of the sealing member accommodating recess 26, and the axis of the insertion hole 27 match the rotation axis L1 of the rotary shaft 12. The large diameter recess 24 opens in the end face 20*a* of the shaft support housing member 20. The bearing accommodating recess 25 is defined in the bottom surface 24*a* of the large diameter recess 24. The large diameter recess 24 and the bearing accommodating recess 25 are thus continuous with each other. The sealing member accommodating recess 26 is defined in a bottom surface 25*a* of the bearing accommodating recess 25. The bearing accommodating recess 25 and the sealing member accommodating recess 26 are thus continuous with each other. The insertion hole 27 is provided in a bottom surface 26*a* of the sealing member accommodating recess 26 and extends through the bottom wall 21. The sealing member accommodating recess 26 and the insertion hole 27 are thus continuous with each other.

The end of the rotary shaft 12 that is closer to the compression portion 13 is inserted into the insertion hole 27. The end also extends through the sealing member accommodating recess 26 and the bearing accommodating recess 25 to protrude into the large diameter recess 24. The rotary shaft 12 has an end face 12*a* that is opposed to the compression portion 13. The end face 12*a* is located in the large diameter recess 24. The bearing accommodating recess 25 accommodates a bearing 28. The bearing 28 is provided between the outer circumferential surface of the rotary shaft 12 and the inner circumferential surface of the bearing accommodating recess 25. The bearing 28 is a rolling-element bearing. The end of the rotary shaft 12 inside the insertion hole 27 is rotationally supported by the shaft support housing member 20 with the bearing 28. The rotary shaft 12 is thus rotationally supported by the housing 11.

The rotary shaft 12 has an integral eccentric shaft 29 on the end face 12*a*. The eccentric shaft 29 protrudes toward the movable scroll 17 from a position eccentric from the rotation axis L1 of the rotary shaft 12. The direction in which an axis L2 of the eccentric shaft 29 extends (axial direction) matches the axial direction of the rotary shaft 12. The eccentric shaft 29 is inserted into the boss 17*c*.

A bushing 31, which is integrated with a balance weight 30, is fitted about the eccentric shaft 29. The balance weight 30 is integral with the bushing 31. The balance weight 30 is accommodated in the large diameter recess 24. The movable scroll 17 is supported by the eccentric shaft 29 with the bushing 31 and the rolling-element bearing 32 so as to be rotational relative to the eccentric shaft 29. The eccentric shaft 29 thus supports the movable scroll 17.

The shaft support housing member 20 is an opposed wall that is located on the opposite side of the movable base plate 17*a* to the stationary base plate 16*a*. Thus, the opposed wall is a part of the housing 11 in the present embodiment.

A flat annular elastic plate 50 is disposed between the end face 17*e* of the movable base plate 17*a* and the end face 20*a* of the shaft support housing member 20. Therefore, the end face 20*a* of the shaft support housing member 20 corresponds to an opposed surface of the opposed wall that is opposed to the elastic plate 50. The elastic plate 50 is arranged in the housing 11 on the opposite side of the movable scroll 17 to the stationary scroll 16. The elastic plate 50 is made of an elastically deformable material such as a metal.

The elastic plate 50 has a circular through-hole 50*a* at the center. The elastic plate 50 also has multiple pin insertion holes 50*b* about the through-hole 50*a*. The pin insertion holes 50*b* are circular holes. The pin insertion holes 50*b* are arranged at equal intervals in the circumferential direction of the rotary shaft 12. An outer circumferential edge 50*e* of the elastic plate 50 is held between the end face of the extended portion 16*f* of the stationary scroll 16 and an outer circumferential portion 20*e* of the end face 20*a* of the shaft support housing member 20. The elastic plate 50 is thus fixed and supported between the end face 17*e* of the movable base plate 17*a* and the end face 20*a* of the shaft support housing member 20.

The diameter of the through-hole 50*a* is larger than the outer diameter of the boss 17*c* of the movable scroll 17. The diameter of the through-hole 50*a* is equal to the diameter of the large diameter recess 24. The elastic plate 50 is arranged between the end face 17*e* of the movable base plate 17*a* and the end face 20*a* of the shaft support housing member 20 such that the axis of the through-hole 50*a* matches the axis of the large diameter recess 24. The inner circumferential edge of the through-hole 50*a* overlaps with the inner circumferential surface of the large diameter recess 24 in the axial direction of the rotary shaft 12.

Figure 3:
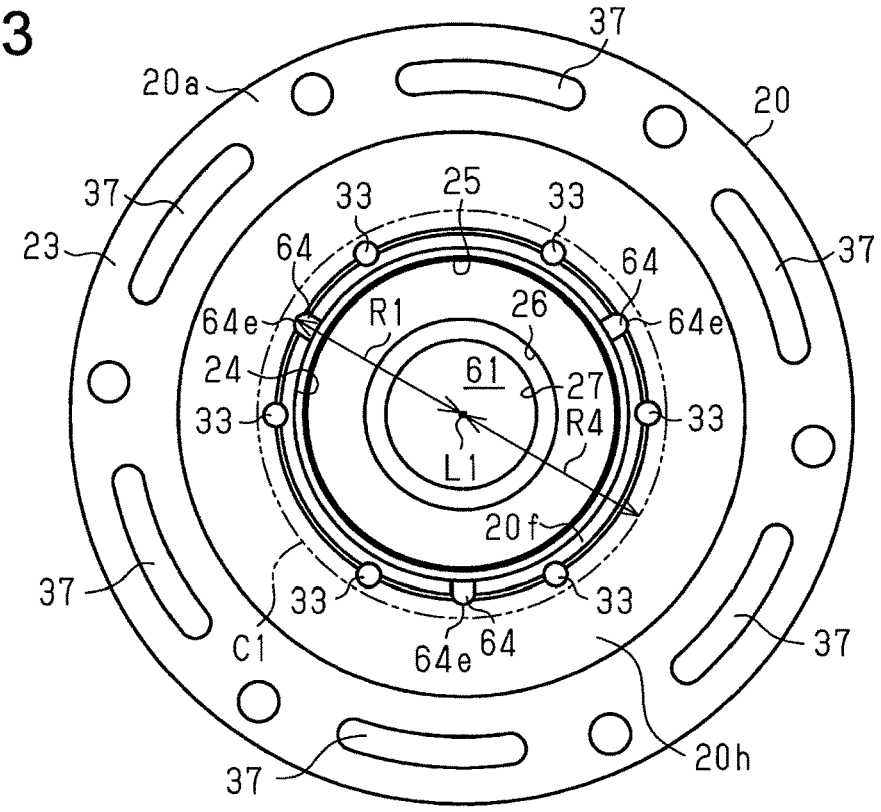
FIG. 3 is a plan view of a shaft support housing member.

As shown in FIGS. 2 and 3, the end face 20*a* of the shaft support housing member 20 has an annular support portion 20*f*, which supports the elastic plate 50. The shaft support housing member 20 includes an annular looped groove 20*h*, which is located on the end face 20*a*. The looped groove 20*h* is located on the outer side of the support portion 20*f* in the radial direction of the rotary shaft 12. The inner circumferential side of the looped groove 20*h* is continuous with the support portion 20*f*.

The shaft support housing member 20 has multiple pins 33, which protrude from the end face 20*a* of the shaft support housing member 20. The pins 33 are arranged at predetermined intervals in the circumferential direction of the rotary shaft 12. In the present embodiment, six pins 33 protrude from the end face 20*a* of the shaft support housing member 20. The pins 33 are thus arranged at 60-degree intervals in the circumferential direction of the rotary shaft 12. Each pin 33 is provided on the shaft support housing member 20 to be arranged over the boundary between the support portion 20*f* and the looped groove 20*h*. Each pin 33 extends through the corresponding pin insertion holes 50*b* of the elastic plate 50 and is inserted into the corresponding ring member 17*d*.

As shown in FIG. 2, rotation of the rotary shaft 12 is transmitted to the movable scroll 17 via the eccentric shaft 29, the bushing 31, and the rolling-element bearing 32, so that the movable scroll 17 rotates. The contact between the pins 33 and the inner circumferential surfaces of the respective ring members 17*d* prevents the movable scroll 17 from rotating and allows the movable scroll 17 to orbit. Thus, the respective pins 33 and the corresponding ring members 17*d* constitute an anti-rotation mechanism 34, which prevents rotation of the movable scroll 17.

The movable volute wall 17*b* orbits about the rotation axis L1 of the rotary shaft 12 with the movable volute wall 17*b* contacting the stationary volute wall 16*b* while being prevented from rotating. The movable scroll 17 is thus permitted to orbit with respect to the stationary scroll 16. The orbiting motion of the movable scroll 17 with respect to the stationary scroll 16 reduces the volume of the compression chamber 18, so that refrigerant that has been drawn into the compression chamber 18 is compressed. The balance weight 30 cancels out the centrifugal force acting on the movable scroll 17 when the movable scroll 17 orbits, thereby reducing the amount of imbalance of the movable scroll 17.

The housing 11 has a back pressure chamber 60 defined therein. The back pressure chamber 60 includes a first back pressure space 61 and a second back pressure space 62 in the housing 11. The first back pressure space 61 is located on the inner side of the support portion 20*f* in the radial direction of the rotary shaft 12. The second back pressure space 62 is located between the movable base plate 17*a* and the elastic plate 50 and on the inner side of the protrusion 17*f* in the radial direction of the rotary shaft 12. The first back pressure space 61 is defined by the end face 17*e* of the movable base plate 17*a* and the large diameter recess 24 of the shaft support housing member 20. The second back pressure space 62 is continuous with the first back pressure space 61 via the through-hole 50*a* of the elastic plate 50. The back pressure chamber 60 is defined at a position in the housing 11 that is on the opposite side of the movable base plate 17*a* to the stationary base plate 16*a*. The shaft support housing member 20 cooperates with the movable base plate 17*a* to define the back pressure chamber 60. The shaft support housing member 20 also defines the back pressure chamber 60 and the motor chamber 40*s*. The second back pressure space 62 is located not only in the anti-rotation recesses 17*h*, but also extends to the inner circumferential surface of the protrusion 17*f*.

The movable scroll 17 has a back pressure introducing passage 63, which extends through the movable base plate 17*a* and the movable volute wall 17*b*. One end of the back pressure introducing passage 63 is open in the back pressure chamber 60. The back pressure introducing passage 63 connects the compression chamber 18 and the back pressure introducing passage 63 to each other to introduce refrigerant that has been compressed in the compression chamber 18 to the back pressure chamber 60. Since the refrigerant in the compression chamber 18 is introduced into the back pressure chamber 60 via the back pressure introducing passage 63, the pressure in the back pressure chamber 60 is higher than that of the motor chamber 40*s*.

The movable scroll 17 is urged toward the stationary scroll 16 by the pressure of the refrigerant that is supplied to the first back pressure space 61 of the back pressure chamber 60 and the pressure of the refrigerant that is supplied to the second back pressure space 62 of the back pressure chamber 60, so that the distal end face of the movable volute wall 17*b* is pressed against the stationary base plate 16*a*. Thus, refrigerant, which is fluid that urges the movable scroll 17 toward the stationary scroll 16, is introduced into the back pressure chamber 60.

The rotary shaft 12 has an in-shaft passage 12*h*, which connects the first back pressure space 61 of the back pressure chamber 60 and the rolling-element bearing 40*d*. One end of the in-shaft passage 12*h* is open in the end face 12*a* of the rotary shaft 12. The other end of the in-shaft passage 12*h* is open in a part of the outer circumferential surface of the rotary shaft 12 that is supported by the rolling-element bearing 40*d*. The in-shaft passage 12*h* connects the first back pressure space 61 and the motor chamber 40*s* to each other.

The sealing member accommodating recess 26 accommodates a sealing member 35. The sealing member 35 is disposed between the outer circumferential surface of the rotary shaft 12 and the inner circumferential surface of the sealing member accommodating recess 26. The sealing member 35 fills, in a fluid-tight manner, the gap between the outer circumferential surface of the rotary shaft 12 and the inner circumferential surface of the sealing member accommodating recess 26. The sealing member 35 limits flow of refrigerant between the first back pressure space 61 and the motor chamber 40*s* via the sealing member accommodating recess 26 and the insertion hole 27.

The protrusion 17*f* protrudes from a part of the movable base plate 17*a* that overlaps with the looped groove 20*h* in the axial direction of the rotary shaft 12. The distal end of the protrusion 17*f* contacts the elastic plate 50. Since the protrusion 17*f* of the movable scroll 17 contacts the elastic plate 50, the elastic plate 50 is pushed by the movable scroll 17 and elastically deformed in the thickness direction. The movable scroll 17 orbits with respect to the stationary scroll 16 while the distal end of the protrusion 17*f* of the movable scroll 17 is kept in contact with the elastic plate 50.

Since the protrusion 17*f* contacts the elastic plate 50, the elastic plate 50 is elastically deformed to bulge away from the movable base plate 17*a*. The looped groove 20*h* allows the elastic plate 50 to be elastically deformed. The restoring force that acts to restore the original shape of the elastic plate 50 acts on the protrusion 17*f* of the movable scroll 17, so that the movable scroll 17 is urged toward the stationary scroll 16. The elastic plate 50 thus urges the movable scroll 17 toward the stationary scroll 16.

The motor housing member 40 has a first groove 36 defined in a part of the inner circumferential surface of the circumferential wall 40*b*. The first groove 36 opens in the opening end of the circumferential wall 40*b*. The shaft support housing member 20 has first holes 37 defined in the outer circumferential portion of the flange wall 23. The first holes 37 are continuous with the first groove 36. The first holes 37 extend through the flange wall 23 in the thickness direction. Further, the discharge housing member 15 has a second groove 38 defined in a part of the inner circumferential surface of the circumferential wall 15*b* of the discharge housing member 15. The second groove 38 is continuous with the first holes 37. Also, the stationary outer circumferential wall 16*c* of the stationary scroll 16 has a second hole 39, which extends through the stationary outer circumferential wall 16*c* in the thickness direction. The second hole 39 is continuous with the second groove 38. The second hole 39 is continuous with the outermost part of the compression chamber 18.

The refrigerant in the motor chamber 40*s* is drawn into the outermost part of the compression chamber 18 through the first groove 36, the first holes 37, the second groove 38, and the second hole 39. The refrigerant that has been drawn into the outermost part of the compression chamber 18 is compressed in the compression chamber 18 by orbiting motion of the movable scroll 17.

A space K1 that is on the inner side of the extended portion 16*f* of the stationary scroll 16 and is on the outer side in the radial direction of the rotary shaft 12 of the part of the protrusion 17*f* of the movable scroll 17 that contacts the elastic plate 50 is a suction pressure zone into which the refrigerant flows from the second hole 39. The contact between the distal end of the protrusion 17*f* of the movable scroll 17 and the elastic plate 50 limits the flow of the refrigerant from the second back pressure space 62 to the space K1 through between the protrusion 17*f* of the movable scroll 17 and the elastic plate 50.

A part of the second back pressure space 62 overlaps with the looped groove 20*h* in the axial direction of the rotary shaft 12 with the elastic plate 50 in between. A part of the space K1 overlaps with the looped groove 20*h* in the axial direction of the rotary shaft 12 with the elastic plate 50 in between.

As shown in FIGS. 2 and 3, back pressure supplying grooves 64 are provided in the end face 20*a* of the shaft support housing member 20 in some parts in the circumferential direction of the rotary shaft 12. The back pressure supplying grooves 64 extend beyond the support portion 20*f* to connect the first back pressure space 61 and the looped groove 20*h* to each other. The back pressure supplying grooves 64 are arranged at equal intervals in the circumferential direction of the rotary shaft 12. In the present embodiment, three back pressure supplying grooves 64 are provided in the end face 20*a* of the shaft support housing member 20. Thus, the back pressure supplying grooves 64 are arranged at 120-degree intervals in the circumferential direction of the rotary shaft 12. Each back pressure supplying groove 64 is located between two of the pins 33 that are adjacent to each other in the circumferential direction of the rotary shaft 12 and is spaced apart from the two pins 33 by the same distance. The back pressure supplying grooves 64 supply the refrigerant in the first back pressure space 61 to the looped groove 20*h*.

The distance in the radial direction of the rotary shaft 12 from the rotation axis L1 of the rotary shaft 12 to an outer end 64*e* of each back pressure supplying groove 64 in the radial direction of the rotary shaft 12 is referred to as a distance R1. The distance in the radial direction of the rotary shaft 12 from the axis L2 of the eccentric shaft 29 to the part of the protrusion 17*f* that contacts the elastic plate 50 is referred to as a distance R2. The distance in the radial direction of the rotary shaft 12 between the rotation axis L1 of the rotary shaft 12 and the axis L2 of the eccentric shaft 29 is referred to as a distance R3. The distance R1 is shorter than a distance R4 that is obtained by subtracting the distance R3 from the distance R2. Specifically, the distance R1 is shorter than the distance R4.

The operation of the present embodiment will now be described.

The refrigerant in the compression chamber 18 is introduced to the back pressure chamber 60 via the back pressure introducing passage 63, and the movable scroll 17 is urged toward the stationary scroll 16 by the pressure of the refrigerant in the first back pressure space 61 and the pressure of the refrigerant in the second back pressure space 62. This causes the distal end face of the movable volute wall 17*b* to contact the stationary base plate 16*a* and causes the distal end face of the stationary volute wall 16*b* to contact the movable base plate 17*a*. This ensures the sealing of the compression chamber 18.

When the movable scroll 17 orbits with respect to the stationary scroll 16 with the protrusion 17*f* contacting the elastic plate 50, the looped groove 20*h* allows the elastic plate 50 to be elastically deformed on the side opposite to the movable base plate 17*a*. The restoring force that acts to restore the original shape of the elastic plate 50 acts on the protrusion 17*f* of the movable scroll 17, so that the movable scroll 17 is urged toward the stationary scroll 16. This configuration urges the movable scroll 17 toward the stationary scroll 16 to improve the sealing of the compression chamber 18 even when the pressure of the refrigerant introduced to the back pressure chamber 60 has not been increased, for example, when the scroll compressor 10 is started.

The fluid in the first back pressure space 61 is supplied to the entire looped groove 20*h* via the back pressure supplying grooves 64. The pressure of the refrigerant in the back pressure supplying grooves 64 and the pressure of the refrigerant in the looped groove 20*h* limit elastic deformation of the elastic plate 50 into the looped groove 20*h* due to the pressure in the second back pressure space 62. Also, the refrigerant in the back pressure supplying grooves 64 and the pressure supplied to the entire looped groove 20*h* urge the movable scroll 17 toward the stationary scroll 16 via the elastic plate 50 and the pressure in the second back pressure space 62. This allows the movable scroll 17 to stably urge the stationary scroll 16, thereby improving the sealing of the compression chamber 18.

The imaginary circle having a radius equal to the distance R4, which is obtained by subtracting the distance R2 from the distance R3, and a center coinciding with rotation axis L1 of the rotary shaft 12 is defined as an imaginary circle C1. The imaginary circle C1 is the locus of a part of the protrusion 17*f* of the movable scroll 17 that contacts the elastic plate 50 and is closest to the rotation axis L1 of the rotary shaft 12 when the movable scroll 17 orbits about the rotation axis L1 of the rotary shaft 12.

It is now assumed, for example, that the distance R1 is longer than the distance R4, which is obtained by subtracting the distance R3 from the distance R2. In this case, the ends 64*e* of the back pressure supplying grooves 64 are located on the outer side of the imaginary circle C1. Thus, when the movable scroll 17 is orbiting, the ends 64*e* of the back pressure supplying grooves 64 are located on the outer side of the part of the protrusion 17*f* of the movable scroll 17 that contacts the elastic plate 50 when viewed in the axial direction of the rotary shaft 12, or on the outer side of the second back pressure space 62. Therefore, the ends 64*e* of the back pressure supplying grooves 64 overlap with the space K1 in the axial direction of the rotary shaft 12 with the elastic plate 50 in between when the movable scroll 17 is orbiting.

Since the pressure in the space K1 is the suction pressure, the pressure in the space K1 is lower than the pressure in the back pressure supplying grooves 64. When the refrigerant in the first back pressure space 61 is supplied to the looped groove 20*h* via the back pressure supplying grooves 64, the refrigerant from the first back pressure space 61 concentrates in the back pressure supplying grooves 64. The pressure in the back pressure supplying grooves 64 is locally higher than the pressure in the looped groove 20*h*. Particularly, when the scroll compressor 10 is started, the refrigerant may have been liquefied. In this case, the liquefied refrigerant may be introduced into the back pressure chamber 60 via the back pressure introducing passage 63 and flow into the back pressure supplying grooves 64 from the first back pressure space 61. In such a case, the difference between the pressure in the space K1 and the pressure in each back pressure supplying groove 64 is great. Thus, the elastic plate 50 is likely to be locally deformed into the space K1 by receiving the pressure in the back pressure supplying grooves 64.

In this respect, the distance R1 is set to be shorter than the distance R4, which is obtained by subtracting the distance R3 from the distance R2, in the present embodiment. In this configuration, the ends 64*e* of the back pressure supplying grooves 64 are located on the inner side of the imaginary circle C1. Thus, when the movable scroll 17 is orbiting, the ends 64*e* of the back pressure supplying grooves 64 are not located on the outer side of the part of the protrusion 17*f* of the movable scroll 17 that contacts the elastic plate 50 when viewed in the axial direction of the rotary shaft 12. That is, the ends 64*e* are always on the inner side of the second back pressure space 62. Thus, even if the pressure in the back pressure supplying grooves 64 acts on the elastic plate 50, the pressure in the second back pressure space 62 limits deformation of the elastic plate 50. This limits local deformation of the elastic plate 50 due to the pressure of the back pressure supplying grooves 64.

The above described embodiment has the following advantages.

(1) The distance R1 is shorter than a distance R4 that is obtained by subtracting the distance R3 from the distance R2. With this configuration, when the movable scroll 17 is orbiting, the ends 64*e* of the back pressure supplying grooves 64 are not located on the outer side of the part of the protrusion 17*f* of the movable scroll 17 that contacts the elastic plate 50 when viewed in the axial direction of the rotary shaft 12. That is, the ends 64*e* are always on the inner side of the second back pressure space 62. Thus, even if the pressure in the back pressure supplying grooves 64 acts on the elastic plate 50, the elastic plate 50 is prevented from being deformed by the pressure in the second back pressure space 62. This limits local deformation of the elastic plate 50, which urges the movable scroll 17 toward the stationary scroll 16, due to the pressure of the back pressure supplying grooves 64.

(2) The back pressure supplying grooves 64 are arranged at equal intervals in the circumferential direction of the rotary shaft 12. This configuration smoothly supplies the refrigerant in the first back pressure space 61 to the entire looped groove 20*h* via the back pressure supplying grooves 64. It is thus easy to limit elastic deformation of the elastic plate 50 into the looped groove 20*h* due to the pressure in the second back pressure space 62. This readily allows the movable scroll 17 to stably urge the stationary scroll 16.

(3) Since the pressure of the refrigerant in the compression chamber 18 is high, the pressure of the refrigerant that is introduced to the back pressure chamber 60 from the compression chamber 18 via the back pressure introducing passage 63 is high. Accordingly, the pressure of the refrigerant that flows from the first back pressure space 61 to the back pressure supplying grooves 64 is also high. In this case, even if the pressure in the back pressure supplying grooves 64 acts on the elastic plate 50, the pressure in the second back pressure space 62 limits deformation of the elastic plate 50.

(4) Each back pressure supplying groove 64 is located between two of the pins 33 that are adjacent to each other in the circumferential direction of the rotary shaft 12 and is spaced apart from the two pins 33 by the same distance. As compared to a case in which the back pressure supplying grooves 64 are each arranged to be closer to one of two of the pins 33 that are adjacent to each other in the circumferential direction of the rotary shaft 12, the flow of refrigerant from the back pressure supplying grooves 64 to the looped groove 20*h* is unlikely to be hindered by the pins 33. This configuration smoothly supplies the refrigerant in the first back pressure space 61 to the entire looped groove 20*h* via the back pressure supplying grooves 64. It is thus easy to limit elastic deformation of the elastic plate 50 into the looped groove 20*h* due to the pressure in the second back pressure space 62. This readily allows the movable scroll 17 to stably urge the stationary scroll 16.

The above-described embodiment may be modified as follows. The above-described embodiment and the following modifications can be combined as long as the combined modifications remain technically consistent with each other.

Figure 4:
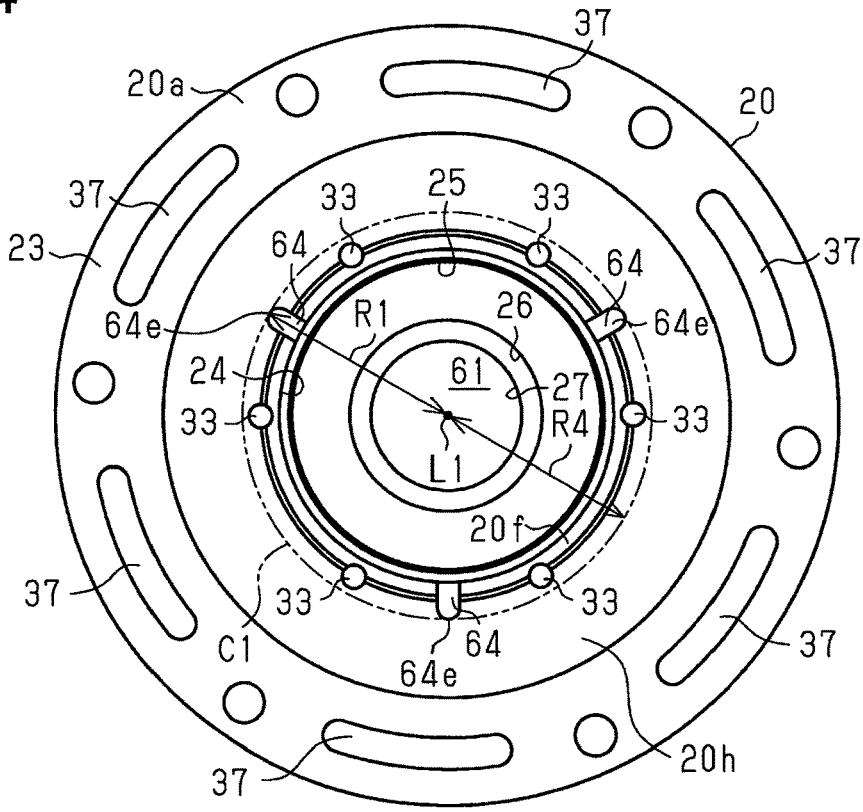
FIG. 4 is a plan view of a shaft support housing member according to another embodiment.
Figure 6:
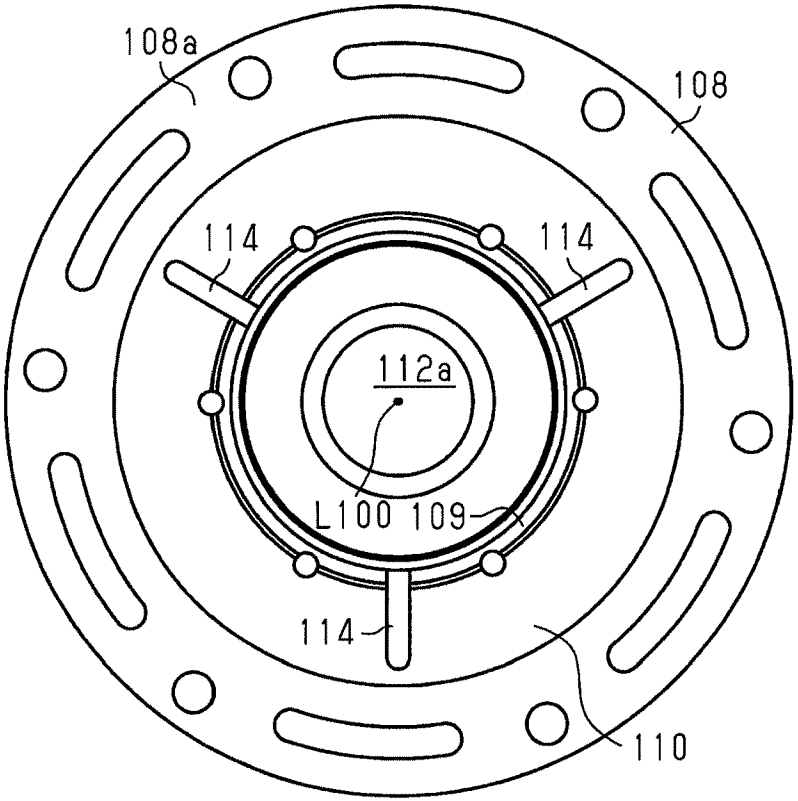
Fig.6(PRIOR ART)
FIG. 6 is a plan view of the opposed wall in the conventional scroll compressor of FIG. 5.
Figure 5:
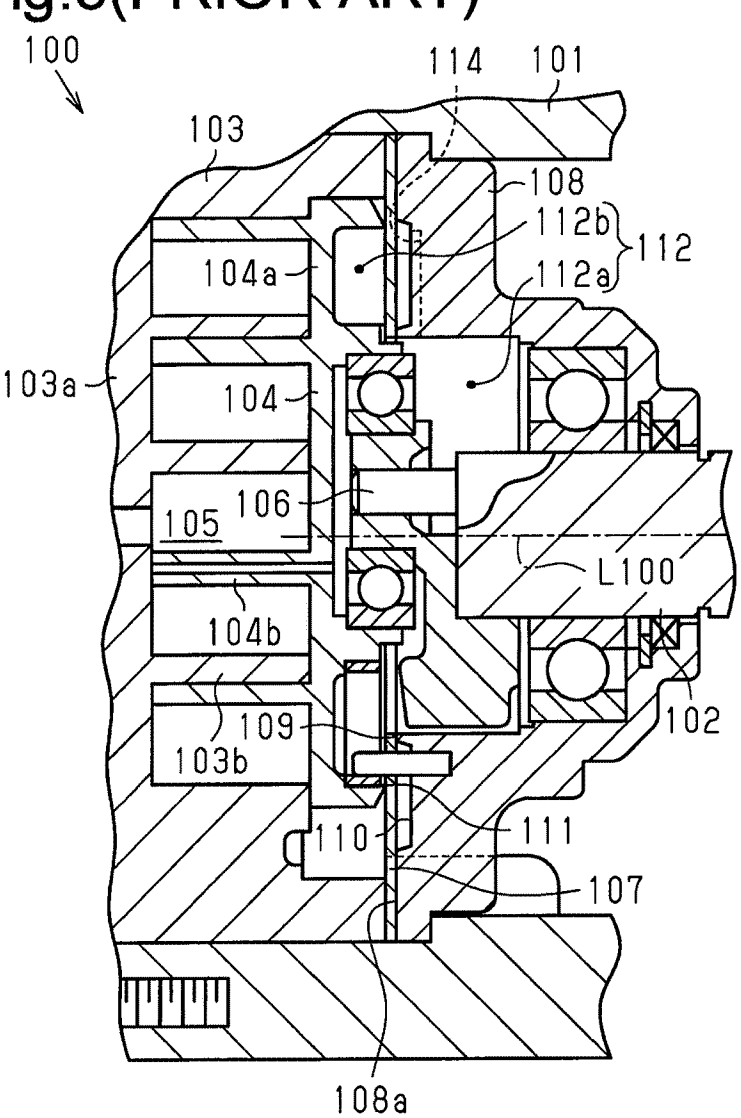
Fig.5(PRIOR ART)
FIG. 5 is an enlarged cross-sectional view showing a part of a conventional scroll compressor.

As shown in FIG. 4, the distance R1 may be equal to the distance R4, which is obtained by subtracting the distance R3 from the distance R2. This configuration maximizes the length of the back pressure supplying grooves 64 in the radial direction of the rotary shaft 12. This configuration smoothly supplies the refrigerant in the first back pressure space 61 to the entire looped groove 20*h* via the back pressure supplying grooves 64. It is thus easy to limit elastic deformation of the elastic plate 50 into the looped groove 20*h* due to the pressure in the second back pressure space 62. This readily allows the movable scroll 17 to stably urge the stationary scroll 16.

In the above-described embodiment, the back pressure supplying grooves 64 do not necessarily need to be arranged at equal intervals in the circumferential direction of the rotary shaft 12.

In the above-described embodiment, the number of the back pressure supplying grooves 64 may be one. Also, the number of the back pressure supplying grooves 64 may be two or greater than three. In short, the number of the back pressure supplying grooves 64 is not limited.

In the above-described embodiment, each back pressure supplying groove 64 may be located between two of the pins 33 that are adjacent to each other in the circumferential direction of the rotary shaft 12, while being closer to one of the two pins 33.

In the above-described embodiment, the scroll compressor 10 may be configured to introduce the refrigerant that has been discharged to the discharge chamber 19 to the back pressure chamber 60.

In the above illustrated embodiment, the number of the pins 33 is not limited. The number of the anti-rotation recesses 17*h* simply needs to be changed in accordance with the number of the pins 33.

In the above-described embodiment, the opposed wall, which is located on the opposite side of the movable base plate 17*a* to the stationary base plate 16*a* does not necessarily need to be a part of the housing 11, but may be a member that is accommodated in the housing 11.

In the above-described embodiment, the stationary base plate 16*a* does not necessarily need to be disk-shaped, but may have any shape.

In the above-described embodiment, the movable base plate 17*a* does not necessarily need to be disk-shaped, but may have any shape.

In the above-described embodiment, the elastic plate 50 does not necessarily need to be annular, but may have any shape.

In the above-described embodiment, the elastic plate 50 may be made of any material that is elastically deformable.

In the above-described embodiment, the scroll compressor 10 does not need to be of a type that is driven by the electric motor 14, but may be of a type that is driven by a vehicle engine.

In the above illustrated embodiment, the scroll compressor 10 does not need to be used in a vehicle air conditioner, but may be used in other air conditioners. For example, the scroll compressor 10 may be mounted on a fuel cell vehicle and use the compression portion 13 to compress air, which is fluid supplied to the fuel cell.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A scroll compressor comprising:

a housing;

a rotary shaft that is rotationally supported by the housing;

a stationary scroll that includes a stationary base plate and a stationary volute wall extending from the stationary base plate, the stationary scroll being fixed to the housing;

a movable scroll including a movable base plate that is opposed to the stationary base plate, and a movable volute wall that extends from the movable base plate toward the stationary base plate and meshes with the stationary volute wall, wherein the movable scroll is capable of orbiting with respect to the stationary scroll;

an eccentric shaft that protrudes toward the movable scroll from a position in the rotary shaft eccentric from a rotation axis, the eccentric shaft supporting the movable scroll;

an opposed wall that is located on an opposite side of the movable base plate to the stationary base plate;

an elastic plate that is disposed between the movable base plate and the opposed wall and urges the movable scroll toward the stationary scroll;

a looped support portion that is provided on an opposed surface of the opposed wall that is opposed to the elastic plate, the support portion supporting the elastic plate;

a looped groove that is provided in the opposed surface on an outer side of the support portion in a radial direction of the rotary shaft;

an annular protrusion that protrudes from a part of the movable base plate that overlaps with the looped groove in an axial direction of the rotary shaft, the protrusion contacting the elastic plate;

a back pressure chamber including a first back pressure space that is located on an inner side of the support portion in the radial direction of the rotary shaft in the housing, and a second back pressure space that is located between the movable base plate and the elastic plate and on an inner side of the protrusion in the radial direction of the rotary shaft, the second back pressure space being continuous with the first back pressure space, wherein fluid that urges the movable scroll toward the stationary scroll is introduced to the back pressure chamber; and a back pressure supplying groove that is provided in a part of the opposed surface in a circumferential direction of the rotary shaft, extends beyond the support portion to connect the first back pressure space and the looped groove to each other, and supplies fluid in the first back pressure space to the looped groove, wherein a distance in the radial direction of the rotary shaft from the rotation axis of the rotary shaft to an outer end of the back pressure supplying groove in the radial direction of the rotary shaft is shorter than or equal to a distance obtained by subtracting a distance in the radial direction of the rotary shaft between the rotation axis of the rotary shaft and an axis of the eccentric shaft from a distance in the radial direction of the rotary shaft from the axis of the eccentric shaft to a part of the protrusion that contacts the elastic plate.

2. The scroll compressor according to claim 1, wherein the back pressure supplying groove is one of a plurality of back pressure supplying grooves, the back pressure supplying grooves are provided in the opposed surface, and the back pressure supplying grooves are arranged at equal intervals in the circumferential direction of the rotary shaft.

3. The scroll compressor according to claim 1, wherein the movable scroll has a back pressure introducing passage that extends through the movable base plate and the movable volute wall, one end of the back pressure introducing passage is open in the back pressure chamber, and the back pressure introducing passage connects the back pressure chamber to a compression chamber that compresses fluid and introduces fluid that has been compressed in the compression chamber to the back pressure chamber from the compression chamber.

4. The scroll compressor according to claim 1, wherein a plurality of pins is provided on the opposed wall, the pins protruding from the opposed surface and constituting an anti-rotation mechanism that prevents rotation of the movable scroll, the pins are arranged at equal intervals in the circumferential direction of the rotary shaft, and the back pressure supplying groove is located between two of the pins that are adjacent to each other in the circumferential direction of the rotary shaft and is spaced apart from the two pins by the same distance.

5. The scroll compressor according to claim 1, wherein the distance in the radial direction of the rotary shaft from the rotation axis of the rotary shaft to the outer end of the back pressure supplying groove in the radial direction of the rotary shaft is equal to the distance obtained by subtracting the distance in the radial direction of the rotary shaft between the rotation axis of the rotary shaft and the axis of the eccentric shaft from the distance in the radial direction of the rotary shaft from the axis of the eccentric shaft to the part of the protrusion that contacts the elastic plate.

* * * * *